US006110532A

United States Patent [19]

Causton et al.

[11] Patent Number: 6,110,532

[45] Date of Patent: Aug. 29, 2000

[54] METHOD OF COATING CUTTING EDGES

[75] Inventors: Brian Edward Causton, Aldermaston Reading; Edwin Lloyd Glasson, Bracknell, both of United Kingdom

[73] Assignee: The Gillette Company, Boston, Mass.

[21] Appl. No.: 08/926,467

[22] PCT Filed: May 26, 1994

[86] PCT No.: PCT/US94/05925

§ 371 Date: Feb. 6, 1996

§ 102(e) Date: Feb. 6, 1996

[87] PCT Pub. No.: WO94/27744

PCT Pub. Date: Dec. 8, 1994

Related U.S. Application Data

[63] Continuation of application No. 08/553,267, filed as application No. PCT/US94/05925, May 26, 1994, abandoned.

[30] Foreign Application Priority Data

May 28, 1993 [GB] United Kingdom ..... 9311034
May 26, 1994 [WO] WIPO ..... PCT/US94/05925

[51] Int. Cl.[7] ..... B05D 5/00; H05H 1/00

[52] U.S. Cl. ..... 427/284; 427/533; 427/551; 427/566; 427/384; 427/421

[58] Field of Search ..... 427/284, 552, 427/533, 551, 566, 384, 421

[56] References Cited

U.S. PATENT DOCUMENTS

| | | | |
|---|---|---|---|
| 3,071,856 | 1/1963 | Fischbein . | |
| 3,203,829 | 8/1965 | Seyer et al. . | |
| 3,518,110 | 6/1970 | Fischbein . | |
| 3,658,742 | 4/1972 | Fish et al. | 260/29.6 |
| 3,838,512 | 10/1974 | Sanderson | 30/346.54 |
| 4,029,870 | 6/1977 | Brown et al. . | |
| 4,220,511 | 9/1980 | Derbyshire | 204/159.2 |
| 5,263,256 | 11/1993 | Trankiem | 30/346.54 |

FOREIGN PATENT DOCUMENTS

| | | |
|---|---|---|
| 9308926 | 5/1993 | WIPO . |
| 9320952 | 10/1993 | WIPO . |

*Primary Examiner*—Shrive Beck
*Assistant Examiner*—Bret Chen
*Attorney, Agent, or Firm*—Stephan P. Williams

[57] ABSTRACT

Disclosed is a method of coating cutting edges, more particularly razor blade cutting edges, with polytetrafluoroethylene (PTFE). The present method of forming a polytetrafluoroethylene (PTFE) coating on a razor blade cutting edge comprises: spraying the edge of an aqueous dispersion of PTFE having a molecular weight of at least 500,000 to form a coating of the PTFE of the cutting edge; subjecting the PTFE coating to ionizing radiation in the presence of an oxygen containing gas to obtain a radiation dose of up to 50 Mrads, and then sintering the PTFE coating.

14 Claims, No Drawings

METHOD OF COATING CUTTING EDGES

This application is a continuation of Ser. No. 08/553,267 filed Feb. 6, 1996, now abandoned, which is a 371 of PCT/US94/05925 filed May 26, 1994.

This invention is concerned with a method of coating cutting edges, more particularly razor blade cutting edges, with polytetrafluoroethylene (PTFE).

For many years razor blade cutting edges have been coated with PTFE, an early disclosure of the use of such coatings being, for example, British Specification 906005. Such coatings have been shown to improve the shaving effectiveness of the blade edge by reducing the force required to cut through the hair and thus reduce the pull on the hairs of the shaving area which the shaver experiences.

It has been known for some time that for most PTFE-coated razor blades the force required to cut hair with an unused blade, that is the first shave force, is significantly higher than the force required in the immediately following shaves, say the second to fifth shaves, with the same blade edge. It has been postulated that this phenomenon is due to the removal of much of the PTFE coating during the first shave, the difference between the first shave force and that for, say, the second to fifth shaves representing the force required to remove the "excess" polymer.

A number of processes for forming PTFE coatings on razor blade cutting edges have been described (for example, in Specification 906005 already referred to). One process which has been widely used commercially comprises spraying the blade edges with a 1% by weight dispersion of PTFE telomar (having a molecular weight of less than 100,000, for example 5000) in a chlorofluorocarbon and then sintering the PTFE coating formed. As a production process, this has been very satisfactory because it can readily be incorporated into a continuously operated razor blade production line and gives uniform results. However, there is a need to phase out the use of chlorofluorocarbons in industrial processes and, if possible, to use only water as the dispersion vehicle.

We have now developed a method of coating razor blade cutting edges with PTFE which does not require the use of a chlorofluorocarbon or other volatile organic solvent.

According to the present invention, there is provided a method of forming a PTFE coating on a razor blade cutting edge, which comprises spraying the cutting edge with an aqueous dispersion of PTFE having a molecular weight of at least 500,000 to form a coating of the PTFE on the edge subjecting the PTFE coating to ionising radiation in the presence of an oxygen-containing gas to obtain a radiation dose of up to about 60 Mrads (megarads), and then sintering the PTFE coating.

It is possible by the method of the invention to obtain PTFE coatings which do not exhibit the phenomenon, referred to above, of the first shave force being significantly greater than the force required for the second to fifth shaves.

The PTFE starting material preferably has a molecular weight of from 1,000,000 to 2,000,000. This material is conventionally produced by aqueous polymerisation and is conventionally used for forming non-stick coatings on articles, such as cookware. It will be appreciated that at no stage in the production of the PTFE-coated razor blades of the invention, that is neither during the production of the PTFE polymer nor during the formation of the coatings, is a chlorofluorocarbon or other volatile organic solvent necessary. The process is intended to be carried out entirely without the use of such materials so that it is environmentally acceptable throughout. The invention does not, however, exclude the use of such materials.

It is neither required nor desired that PTFE telomers, that is polymers with a molecular weight below about 100,000, should be formed before the actual coating process.

The aqueous dispersion used to form the initial coating preferably contains from 0.15 to 0.5% by weight, more preferably approximately 0.25% by weight of PTFE. The dispersion may contain one or more surfactants to assist dispersion of the PTFE particles.

The spray coating operation may otherwise be carried out in the same way as the spray coating step of the conventional process using a chlorofluorocarbon dispersion of PTFE telomer.

After the coating has been applied to the blades, and before they are irradiated, we prefer to subject them to an oxygen-containing atmosphere. Thus, the blades may advantageously be stored in (or otherwise exposed to) air or another oxygen-containing gas during the interval between coating and irradiation.

Preferred forms of ionising radiation for use in the method according to the invention are electron beam irradiation and gamma-ray irradiation, of which the former is the more preferred. Ultra-violet radiation can also be used.

It appears that the advantageous effect obtained by the present method, that is the reduction in the first shave force, is dependent on the radiation dose and not on other radiation parameters, such as radiation flux. No advantage is obtained by using radiation doses above about 60 Mrad and, indeed, it is preferred to use radiation doses well below this figure, e.g. doses in the range 3 to 30 Mrads, most preferably about 18 to 22 Mrads. Doses below about 1 grad are generally too low for practical purposes.

The irradiation degrades the PTFE to lower molecular weight material, but it appears to be a significant factor in obtaining the observed improvements that only a relatively small proportion of the PTFE should be reduced to a molecular weight below, say, 100,000. It is, therefore, preferred that the radiation dose should be such that approximately 10% by weight of the PTFE in the blade edge coating has its molecular weight reduced to a value below 100,000.

The irradiation should be carried out in an oxygen-containing gas: this may be oxygen or oxygen-enriched air, but is preferably air.

Following irradiation, the blades are again preferably stored in, or exposed to, air (or another oxygen-containing gas) before sintering. After this oxygen soak, the PTFE coating is sintered and conventional conditions may be used for the sintering step. It is preferred to effect sintering at a temperature of from about 305° C. to about 470° C. for approximately from 5 to 3000 seconds. Sintering should be carried out as soon as practicable after the irradiation treatment; if there is a delay of more than 24 hours some of the advantages of the present invention may not be obtained. It is possible by the method of the present invention, to obtain coated blades in which, in use, the first shave force is not significantly greater than the shaving forces required for the second to fifth shaves. Further, comparisons by shave testing panels of blades coated by the method according to the invention with blades coated by the conventional method referred to above (spray coating with CFC dispersion of PTFE telomer; identical sintering conditions) show that in many cases, not only is the perceived first shave force of the blades of the invention lower than that of the conventional blades, but the shaving forces for the second to fifth shaves are also lower. That is to say, it is possible to achieve an appreciable general improvement in the shaving performance in the coated blades of the invention as compared with conventionally coated blades.

In order that the invention may be more fully understood, the following Examples are given by way of illustration only.

EXAMPLE 1

Sharpened stainless steel blades were heated to 100° C. in an oven and then sprayed with an aqueous 0.25% suspension of TE 3170 PTFE (supplied by du Pont) of molecular weight >1 MM (1 million). The blades were sprayed at a rate of 2 ml/sec/1000 $mm^2$. The sprayed blades were then irradiated in an electron beam (4.5 eV. 20 mA) to give a total dose of 3 Mrads. After irradiation in air, the blades were sintered at 340° C. for 25 seconds. The resulting coated blades had low first cut values and good polymer adhesion.

EXAMPLE 2

Instead of using an electron beam in Example 1, gama irradiation can be used. For is example, Co 60 radiation can be used for 50 Mrads dose, followed by sintering at 400° C. for 20 minutes in cracked ammonia. A PTFE of high molecular weight (eg. >1 MM) is preferred, for example TE 3170.

EXAMPLE 3

Example 1 was repeated with intervals of several hours between spraying and irradiating, and between irradiating and sintering. For comparative purposes, some of the blades were stored under vacuum during these intervals, and the others were stored in air. Samples of each were subjected to various doses of irradiation from 3 to 30 Mrads. The best results in terms of shaving effectiveness of the final blades were obtained from those which had been stored for one or both intervals in air. The preferred irradiation dose was 18 to 22 Mrads.

We claim:

1. A method of forming a polytetrafluoroethylene (PTFE) coating on a razor blade cutting edge, which method comprises coating said cutting edge with an aqueous dispersion of PTFE having a molecular weight of at least 500,000 to form a PTFE-coated edge, irradiating said PTFE-coated edge with ionizing radiation in the presence of an oxygen-containing gas at a radiation dose of up to 60 megarads to form an irradiated PTFE-coated edge, then sintering said irradiated PTFE-coated edge.

2. The method of claim 1 wherein said ionizing radiation is electron beam or gamma radiation and said sintering is conducted at from about 305° C. to about 470° C.

3. The method of claim 2 wherein said radiation dose is sufficient to reduce the molecular weight of the PTFE on said PTFE-coated edge such that approximately 10% of said PTFE has a molecular weight below 100,000.

4. The method of claim 2 wherein said PTFE-coated edge is exposed to an oxygen-containing gas before it is irradiated and said irradiated PTFE-coated edge is exposed to an oxygen-containing gas before it is sintered.

5. The method of claim 1 wherein the PTFE in said aqueous dispersion has a molecular weight of 1,000,000 to 2,000,000.

6. The method of claim 5 wherein said ionizing radiation is electron beam or gamma radiation.

7. The method of claim 6 wherein said radiation dose is from 3 to 30 megarads.

8. The method of claim 7 wherein said sintering is conducted at from about 305° C. to about 470° C.

9. The method of claim 8 wherein said PTFE-coated edge is exposed to an oxygen-containing gas before it is irradiated.

10. The method of claim 8 wherein said irradiated PTFE-coated edge is exposed to an oxygen-containing gas before it is sintered.

11. The method of claim 8 wherein said radiation dose is sufficient to reduce the molecular weight of the PTFE on said PTFE-coated edge such that approximately 10% of said PTFE has a molecular weight below 100,000.

12. The method of claim 8 wherein said aqueous dispersion comprises 0.15% to 0.5% PTFE.

13. The method of claim 8 wherein said radiation dose is from 18 to 22 megarads.

14. The method of claim 8 wherein said oxygen-containing gas is air.

* * * * *